United States Patent [19]

Nissfolk et al.

[11] Patent Number: 4,956,512

[45] Date of Patent: Sep. 11, 1990

[54] PROCEDURE FOR PRODUCING POLY-ALPHA-OLEFINE-TYPE LUBRICANTS

[75] Inventors: Fredrik Nissfolk, Porvoo; Salme Koskimies, Helsinki; Peter Idelman, Vantaa; Matti Nurminen; Salla Roni, both of Porvoo, all of Finland

[73] Assignee: Neste Oy, Finland

[21] Appl. No.: 271,022

[22] Filed: Nov. 14, 1988

[30] Foreign Application Priority Data

Nov. 12, 1987 [FI] Finland ..... 874999

[51] Int. Cl.[5] ..... C07C 2/02

[52] U.S. Cl. ..... 585/521; 585/525

[58] Field of Search ..... 585/521, 525

[56] References Cited

U.S. PATENT DOCUMENTS

| | | | |
|---|---|---|---|
| 3,763,244 | 10/1973 | Shubkin | 585/525 |
| 4,209,654 | 6/1980 | Booth et al. | 585/525 |
| 4,227,027 | 10/1980 | Booth et al. | 585/525 |
| 4,239,930 | 12/1980 | Allphin et al. | 585/525 |
| 4,420,647 | 12/1983 | Hammond et al. | 585/525 |
| 4,454,366 | 6/1984 | Vogel et al. | 585/525 |

*Primary Examiner*—Patrick P. Garvin
*Assistant Examiner*—George R. Fourson
*Attorney, Agent, or Firm*—Steinberg & Raskin

[57] ABSTRACT

In producing lubricants by oligomerizing alpha-olefins with the aid of a catalyst of a $BF_3$ and alcohol or carboxylic acid cocatalyst, the utilized catalyst complex can be recovered by distillation and reused as catalyst in a similar oligomerizing process.

10 Claims, 2 Drawing Sheets

PROCEDURE FOR PRODUCING POLY-ALPHA-OLEFINE-TYPE LUBRICANTS

BACKGROUND OF THE INVENTION

The present invention concerns a procedure for producing a poly-alpha-olefine-type lubricant by oligomerizing olefines with the aid of a $BF_3$ cocatalyst complex.

The production methods of a poly-alpha-olefine lubricants known in the art generally consist of the following phases: oligomerizing the starting olefine material; removal of catalyst residues; fractional distillation of the product; and hydration. The most commonly used oligomerization catalysts are of the so-called Friedel-Crafts type, primarily boron trifluoride, in addition to which various alcohols are used as so-called cocatalysts or promotors (please see, e.g., U.S. Pat. Nos. 3,780,128; 4,032,591; 4,376,222; 4,409,415; and 4,587,368), or aluminum halogenides are used (please see, e.g., U.S. Pat. Nos. 2,559,984; 3,637,503; and 3,652,706).

Among these catalysts, boron trifluoride, due to high-level toxicity of fluorine compounds, specifically involves considerable removal and waste handling problems related to catalyst residues, thus resulting in extremely high or remarkable economic expenses.

Known procedures used for removing catalyst residues are primarily washing of an oligomerizing mixture with a concentrated NaOH water solution, and precipitation of the fluorine compounds in the form of solid inorganic salts.

Additionally, procedures for circulating the $BF_3$ catalyst have been developed, such as by binding it to a solid cocatalyst (silicon dioxide) whereby only the part of the $BF_3$ soluble in the oligomerization product is left therein, the separation of which from the product is accomplished with filler piece columns operating at reduced pressure (U.S. Pat. No. 4,263,467). Also, liquid phase separation between the $BF_3$ alcohol catalyst complex and the oligomer product can be performed. Utilization of both these technologies leads, however, to the use of only a $BF_3$ cocatalyst system ($BF_3$*$SiO_2$ or a $BF_3$*alcohol) which does not allow for an optimum oligomerization result and which causes problems in the production of a high-quality product.

SUMMARY OF THE INvENTION

Accordingly, it is an object of the present invention to eliminate the above-described disadvantages with respect to the prior art.

It is also an object of the present invention to improve the production of a poly-alpha-olefine-type lubricant.

It is another object of the present invention to improve conservation of reaction and catalytic materials in such a poly-alpha-olefine-type lubricants/oligomerizing reaction.

It is a further object of the present invention to improve the quality and overall result/yield of oligomerized poly-alpha-olefines.

These and other objects are attained by the present invention which is directed to a method for producing poly-alpha-olefine-type lubricants by oligomerizing the olefine with the aid of a $BF_3$ cocatalyst complex, to form an oligomerization product. This specifically comprises the steps of separating the $BF_3$ cocatalyst complex from the oligomerization product by distillation, and then reusing the thus-separated complex as a catalyst in a subsequent oligomerizing reaction.

Therefore, the present invention concerns a procedure for producing a lubricant of the poly-alpha-olefine-type, which is characterized by the $BF_3$ cocatalyst complex being separated from the oligomerization product by distillation, and reusing the thus-separated complex as a catalyst in a similar oligomerizing reaction.

With this procedure, remarkable savings are achieved both in the total catalyst consumption and in the expenses incurred in removing residues. Additionally, it should be noted that the total reaction time is reduced as compared with a standard batch process, because the circulated catalyst already is in the form of a complex and is able to start the reaction immediately.

It is thus essential in view of the present invention that the $BF_3$ complex circulated by distilling can be reused, as such or after a minor addition of $BF_3$, as an oligomerizing catalyst without essentially changing the quality of the end product. It should also be noted that circulation can be continued innumerable times, thus allowing the maximum use of this catalyst.

BRIEF DESCRIPTION OF THE DRAWINGS

The present invention will be described in greater detail below with reference to the accompanying drawings in which.

DESCRIPTION OF THE PREFERRED EMBODIMENTS

Figure 1:
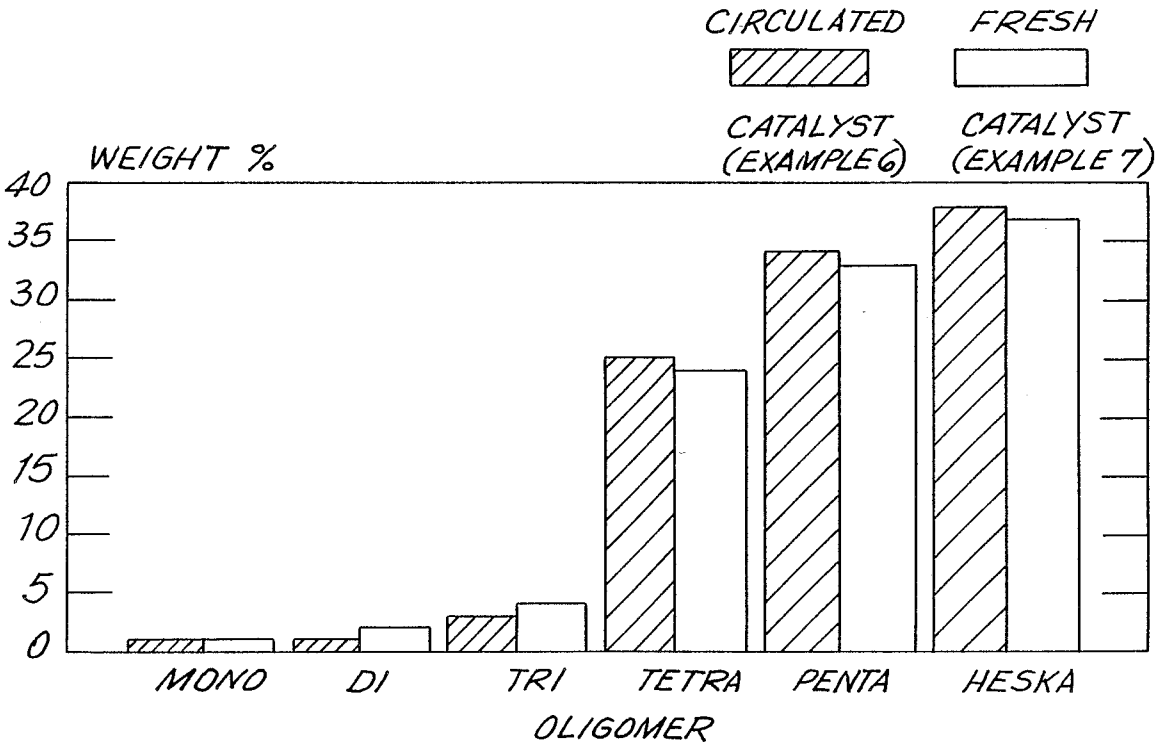
FIG. 1 is a graph illustrating distribution of oligomers obtained in accordance with the present invention.

Additionally, the present invention especially concerns the procedures in which the $BF_3$ catalyst complex is separated from the oligomerization product by distilling, preferably at a low pressure, about 0.1 to 3 mbar, and at a low temperature, about 20° to 100° C. In order to enhance the separation efficiency, the use of distilling columns is recommended.

Compounds which form a stable, relatively low boiling complex with $BF_3$, such as $C_1$–$C_{15}$ alcohols or polyols and $C_1$–$C_7$ carboxylic acids, may be used as cocatalyst. Particularly suitable cocatalysts are $C_1$–$C_{10}$ alcohols.

Either direct chain or branched $C_4$–$C_{20}$ olefins may be used as starting material, however olefins with direct chains are preferably used in which the double bond is located in the 1 position and the length of the chain portion is about 8 to 12 carbon atoms, or mixtures of such olefins are utilized. The invention is suited for use in producing poly-alpha-olefin-type lubricants either as a batch or a continuous action process.

The concentration of the catalyst complex regarding the feeding of olefine in the reaction is about 0.1 to 10 mol %, preferably about 0.5 to 4 mol %.

The present invention will be described in greater detail with the aid of the following examples presented herein:

EXAMPLES 1–5

The reaction was accomplished in a 2 liter Parr autoclave provided with a mixer and an internal heating-/cooling coil. 1-decene and n-butanol or a distilled catalyst complex were weighed into the reactor. Air was removed from the reactor with the aid of vacuum and $N_2$ flushing. The temperature was raised to 30° C. and $BF_3$ gas was supplied at a constant rate to obtain the quantity required in producing the $BF_3$—BuOH complex.

The oligomerization process was performed in the $BF_3$ atmosphere and terminated by supplying nitrogen for about 30 minutes. The catalyst complex was distilled by batch distillation utilizing, as an aid, Vigreux columns at 0.1 to 3 mbar pressure and at 20° to 100° C. temperature of the base. During the collection, the temperature at the top of the distillation column was 40° to 70° C. The distillate was stored under an $N_2$ atmosphere and at room temperature prior to use.

The $BF_3$ residues were removed from the oligomerization product by washing with a 5% NaOH water solution, and the monomer (1-decene) boiling at low temperature and part of the dimer were removed by distillation. The end product was hydrated with the aid of a Raney-Ni catalyst.

The experiments 1 to 5 were carried out in succession, in that the catalyst distillate obtained in the preceding experiment was used as such for the oligomerization catalyst in the next experiment subsequent to a minor $BF_3$ addition. The product features which are presented in Table 1, were determined using standard procedures.

Also, the various footnotes (a), (b), and (c) in Table 1, denote the following:

(a) obtained from the preceding oligomerization experiment as distillate;

(b) feeding at constant rate; and (c) in the first experiment, n-BuOH and equivalent molar quantity of $BF_3$ (fresh catalyst) is used, whereby the catalyst concentration regarding the decene is 10 mol %.

EXAMPLE 6 AND 7

The oligomerization reaction was accomplished using two mixer reactors connected in series, the reaction volumes being 2.15 l. and 4.1 l. Both reactors were provided with a mixer and in inner cooling coil. The following ingredients were supplied into the reactors in continuous action: 0.7 l/h 1-decene; 12.3 g/h n-butanol (Example 6) or 19.2 g/h circulated cocatalyst complex (Example 7) obtained in the form of a product separated from an oligomerization product similar to the one presented in the previous example by distilling; and $BF_3$ gas so that both reactors had about 1.5 bar pressure. The temperature of the first reactor was 10° C. and the temperature of the second reactor was 30° C. The feeding of both the circulated and the fresh catalyst was so controlled that the concentration of the catalyst complex with respect to the decene supply was about 4 mol %.

The distribution of various oligomers of a product oligomerized using continuous-action oligomerization equipment with a fresh (Example 6) and a circulated (Example 7) catalyst is presented in FIG. 1, in which it is seen that a similar product is obtained with the circulated catalyst as with the fresh catalyst.

Figure 2:
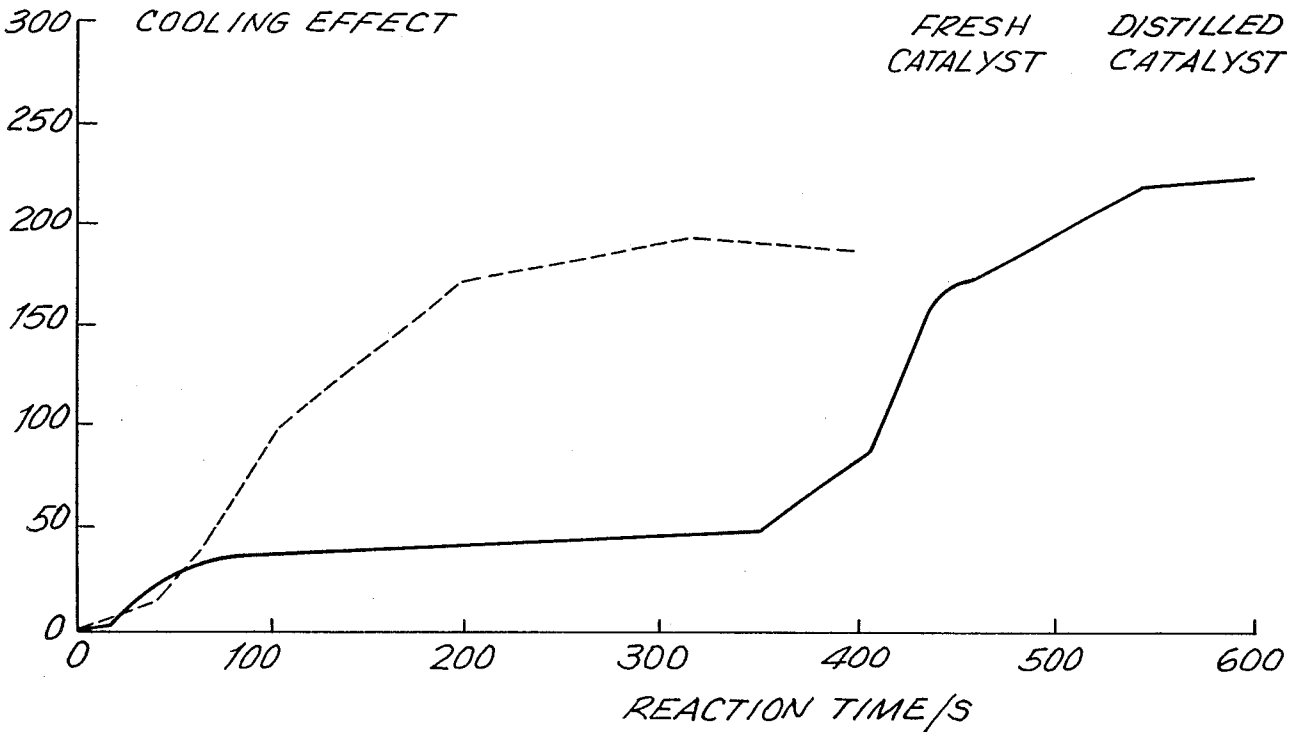
FIG. 2 is a graph illustrating cooling effect of the oligomerizing reaction in accordance with the present invention.

The changing of the cooling effect (it was endeavored to maintain the reaction mixture in isothermic form) of the batch oligomerization (Examples 1 to 5) is presented in FIG. 2, in which it is seen that with the distilled or circulated catalyst, the oligomerization reaction starts at a far greater rate than with the fresh catalyst. A remarkably long induction time is required to form the catalyst complex with the fresh catalyst, and consequently in starting the oligomerization reaction.

The preceding description of the present invention is merely exemplary, and is not intended to limit the scope thereof in any way.

TABLE 1

| | Example 1-5 | | | | |
|---|---|---|---|---|---|
| Example | 1 | 2 | 3 | 4 | 5 |
| Experimental conditions | | | | | |
| Catalyst: n-BuOH/g | 71.8 (c) | | | | |
| $Bf_3$*n-BuOH/g (a) | | 94 | 85 | 73 | 62 |
| $BF_3$ feeding time/min (b) | 32 | 3 | 3 | 3 | 4 |
| Reaction time/h | 1.5 | 1.5 | 1.5 | 1.5 | 1.5 |
| Product yield (monomer conversion)/% | 98 | 93 | 90 | 90 | 88 |
| Product analysis | | | | | |
| Solidification point/° C. | −57 | −57 | −57 | −63 | −57 |
| Kinematic viscosity 40°/cSt | 25.4 | 31.2 | 29.2 | 26.3 | 32.0 |
| Kinematic viscosity 100°/cSt | 5.02 | 5.64 | 5.45 | 5.11 | 5.84 |
| Viscostiy index | 126 | 121 | 123 | 125 | 127 |
| Flash point (COC)/°C. | 232 | 236 | 234 | 236 | 240 |
| Density at 50° C./kg/m$^3$ | 800.4 | 805.3 | 807.4 | 804.6 | 806.0 |
| Density at 15° C./kg/m$^3$ | 821.9 | 826.8 | 828.9 | 826.1 | 827.5 |

What is claimed is:

1. Method for the production of poly-alpha-olefine containing lubricants, which comprises subjecting at least one olefine in the presence of a $BF_3$ cocatalyst complex to oligomerization, thus forming a reaction product comprising a poly-alpha-olefine oligomer and said $BF_3$ cocatalyst complex, wherein said cocatalyst is either a $C_1$–$C_{15}$ alcohol or a $C_1$–$C_7$ carboxylic acid, subjecting the thus formed reaction product to distillation, thereby separating said $BF_3$ cocatalyst complex from said oligomer, and conducting the thus separated $BF_3$ cocatalyst complex to a new oligomerization reaction, whereby said complex acts as catalyst for such oligomerization reaction.

2. The method of claim 1, wherein the olefine is a straight chain or branched $C_4$–$C_{20}$ olefine.

3. The method of claim 2, wherein said olefine is a $C_8$–$C_{12}$ olefine-1.

4. The method of claim 1, wherein said cocatalyst is a $C_1$–$C_{10}$ alcohol.

5. The method of claim 1, additionally comprising performing said separation of said complex from said oligomerization product in a distillation column.

6. The method of claim 5, additionally comprising performing said separating under reduced pressure and temperature.

7. The method of claim 1, additionally comprising performing said oligomerizing as batch or continuous action.

8. The method of claim 1, additionally comprising providing a concentration of catalyst complex of about 0.1 to 10 mol % with respect to the olefine in the feed.

9. The method of claim 8, wherein said provided concentration is about 0.5 to 4 mol %.

10. The method of claim 7, additionally comprising performing said distilling at about 0.1 to 3 mbar pressure and at about 20° to 100° C. temperature.

* * * * *